US009981766B2

(12) United States Patent
Harte et al.

(10) Patent No.: US 9,981,766 B2
(45) Date of Patent: May 29, 2018

(54) METHOD OF APPLYING LABELS USING A PORTABLE LABELING DEVICE

(71) Applicants: James Roy Harte, Shawnee, KS (US); Danny R. Rutledge, Belton, MO (US)

(72) Inventors: James Roy Harte, Shawnee, KS (US); Danny R. Rutledge, Belton, MO (US)

(73) Assignee: UltraSource LLC, Kansas City, MO (US)

( * ) Notice: Subject to any disclaimer, the term of this patent is extended or adjusted under 35 U.S.C. 154(b) by 537 days.

(21) Appl. No.: 13/838,280

(22) Filed: Mar. 15, 2013

(65) Prior Publication Data

US 2014/0262001 A1 Sep. 18, 2014

(51) Int. Cl.

| | |
|---|---|
| ***B65C 9/18*** | (2006.01) |
| ***B65C 9/32*** | (2006.01) |
| ***B65C 1/02*** | (2006.01) |
| ***B65C 9/34*** | (2006.01) |

(52) U.S. Cl.

CPC ..... *B65C 9/32* (2013.01); *B65C 1/02* (2013.01); *B65C 9/1869* (2013.01); *B65C 9/34* (2013.01); *Y10T 156/17* (2015.01)

(58) Field of Classification Search

CPC B65C 1/02; B65C 9/1869; B65C 9/32; B65C 9/34; Y10T 156/17

USPC ..... 156/249, 538, 235, 542

See application file for complete search history.

(56) References Cited

U.S. PATENT DOCUMENTS

| | | | | |
|---|---|---|---|---|
| 5,162,069 A * | 11/1992 | Morris | B65C 9/1869 | 156/354 |
| 5,470,418 A * | 11/1995 | Instance | 156/231 | |
| 5,556,492 A * | 9/1996 | Vonderhorst et al. | 156/64 | |
| 5,725,717 A * | 3/1998 | Harte | B65C 1/02 | 156/265 |
| 7,318,877 B2 * | 1/2008 | Harte | B65C 9/1884 | 156/235 |

* cited by examiner

*Primary Examiner* — Scott W Dodds

(74) *Attorney, Agent, or Firm* — Hovey Williams LLP

(57) ABSTRACT

A portable labeling device is provided for applying labels to a film used in sealing a product package. The labeling device includes a platform mounted for adjustable positioning in relation to the film and a belt that is moveable around rollers associated with the platform. The belt is operable to receive a portion of each of the labels and transport them into registry with the film. A tamp roller is also provided and is moveable into a position pressing another portion of each of the labels against the film. The tamp roller is then movable to another position spaced away from the film when the belt moves around the rollers to transport other ones of the labels into registry with the film.

8 Claims, 10 Drawing Sheets

METHOD OF APPLYING LABELS USING A PORTABLE LABELING DEVICE

BACKGROUND OF THE INVENTION

The present invention relates generally to labeling devices and, more particularly, to labeling devices of the type used to apply labels to an array of packages in form, fill and seal packaging machines or other types of package thermoforming devices. The invention also relates to a method of applying labels using such labeling devices.

Horizontal form-fill-seal machines are conventionally used in the packaging industry to package a wide variety of products in a generally automated assembly-line process. In such machines, continuous rolls of plastic film are used to form the top and bottom of the product packaging in a step-wise, indexing fashion. The products are typically placed on the bottom film after it has been suitably formed to create individual receptacles for the products. The top film is then applied to the bottom film and heat sealed together around the perimeter of the products. The individual product packages may then be separated from each other in a cutting operation.

Labeling of the product packages with product information and other indica in the horizontal form-fill-seal machines described above can be accomplished using conventional labeling devices that apply the labels to the top film before the top film is joined to the bottom film. These conventional labeling devices are normally mounted to the top of the horizontal form-fill-seal machines in a semi-permanent manner, making them difficult to quickly uninstall for use on another form-fill-seal machine. The conventional labeling devices also require rerouting of the top film rerouted through the labeling device, which complicates initial setup of the horizontal form-fill-seal machines. The rerouting of the top film can increase the risk that the top film will not track appropriately, leading to additional machine down-time and product and/or label waste.

The positioning of the conventional labeling devices at the top of horizontal form-fill-seal machines is undesirable because the horizontal form-fill-seal machines may index up to ten times before the labels are advanced with the top film to the machine location where the product package is formed. This can cause significant wasting of product and/or labels during each startup of the horizontal form-fill-seal machines, particularly if the labels or the top film must be repeatedly readjusted to achieve the desired alignment during startup or operation of the machines. Because of the remote location of conventional labeling devices at the top of the horizontal form-fill-seal machines, it may also be difficult to access the labeling devices during initial threading of the top film through the labeling devices as well as during reloading of the labels. A need has thus developed for an improved labeling device.

SUMMARY OF THE INVENTION

In one aspect, the present invention is directed to a labeling device for applying labels to a film used in sealing a product package. The labeling device includes a platform mounted for adjustable positioning in relation to the film and a belt that is moveable around rollers associated with the platform. The belt is operable to receive a portion of each of the labels and transport them into registry with the film. A tamp roller is also provided and is moveable into a position pressing another portion of each of the labels against the film. The tamp roller is then movable to another position spaced away from the film when the belt moves around the rollers to transport other ones of the labels into registry with the film.

In another aspect, the invention is directed to a method of using the labeling device described above to apply labels to a film prior to using the film to seal the product package. The method includes the step of separating one or more of the labels from a web carrying the labels. The separated labels are then advanced onto a moving belt where one portion of each of the labels is releaseably adhered to the moving belt. The movement of the belt is stopped after the labels that are releaseably adhered to the belt are in a preselected registration in relation to the film. Another portion of each of the labels that are releaseably adhered to the belt is then pressed into contact with the film. The film is advanced and the one portion of each of the labels are caused to release from the belt and are brought into contact with the film.

DETAILED DESCRIPTION

Figure 1:
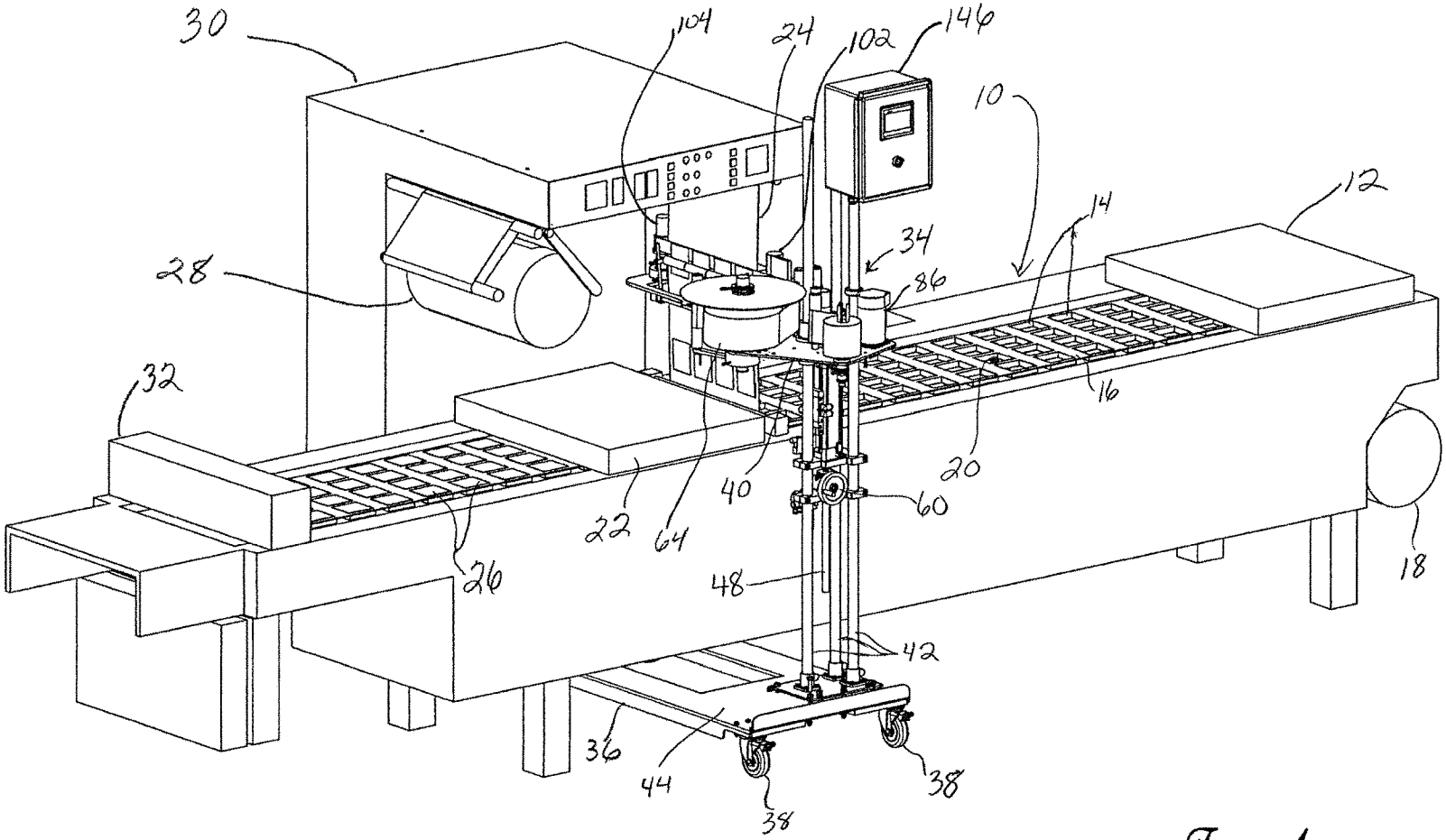
FIG. 1 is a side perspective view of a horizontal form-fill-seal machine and a labeling device constructed in accordance with one embodiment of the present invention.
Figure 2:
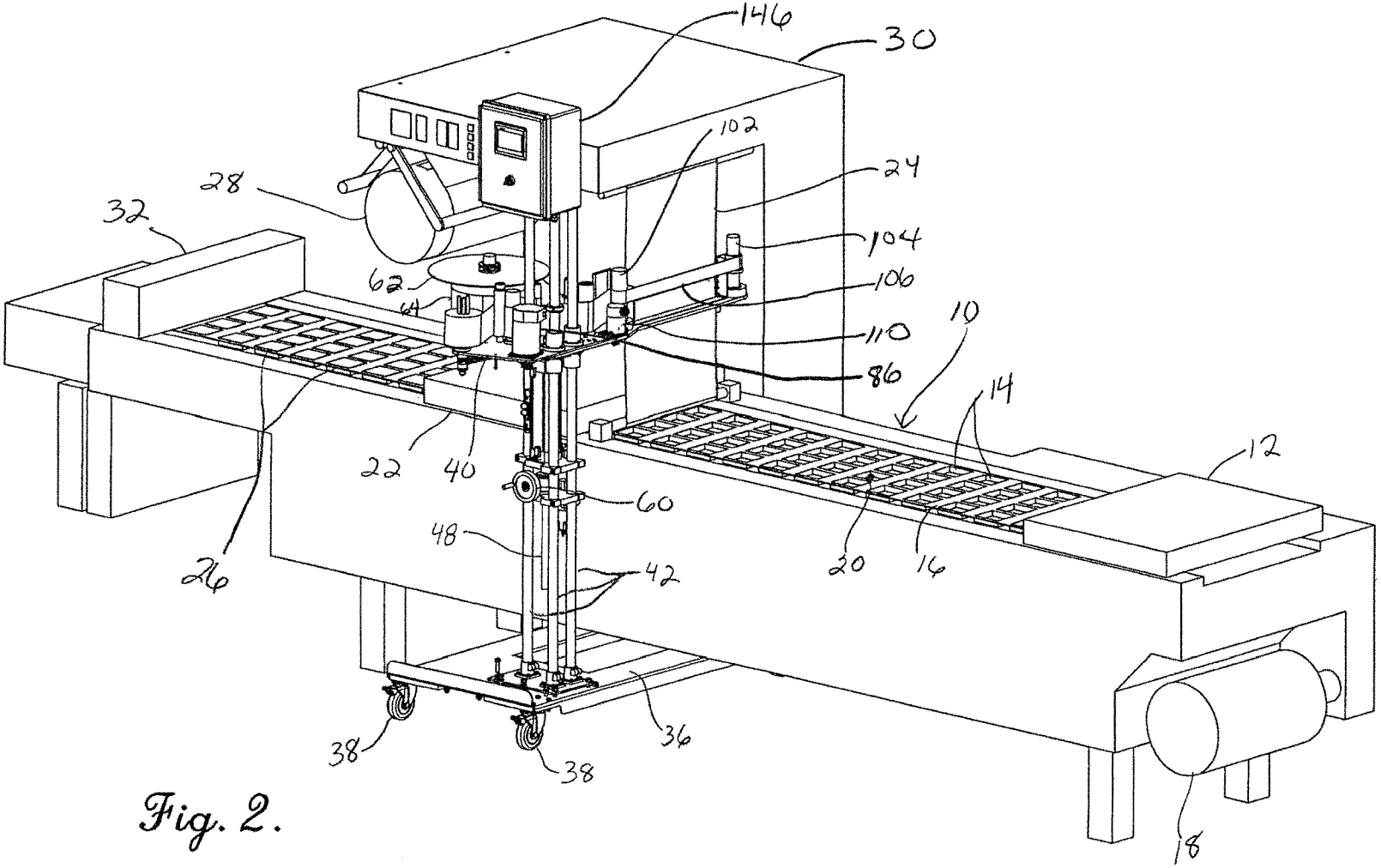
FIG. 2 is a side perspective view of the horizontal form-fill-seal machine and the labeling device shown in FIG. 1, but taken from a different perspective.
Figure 3:
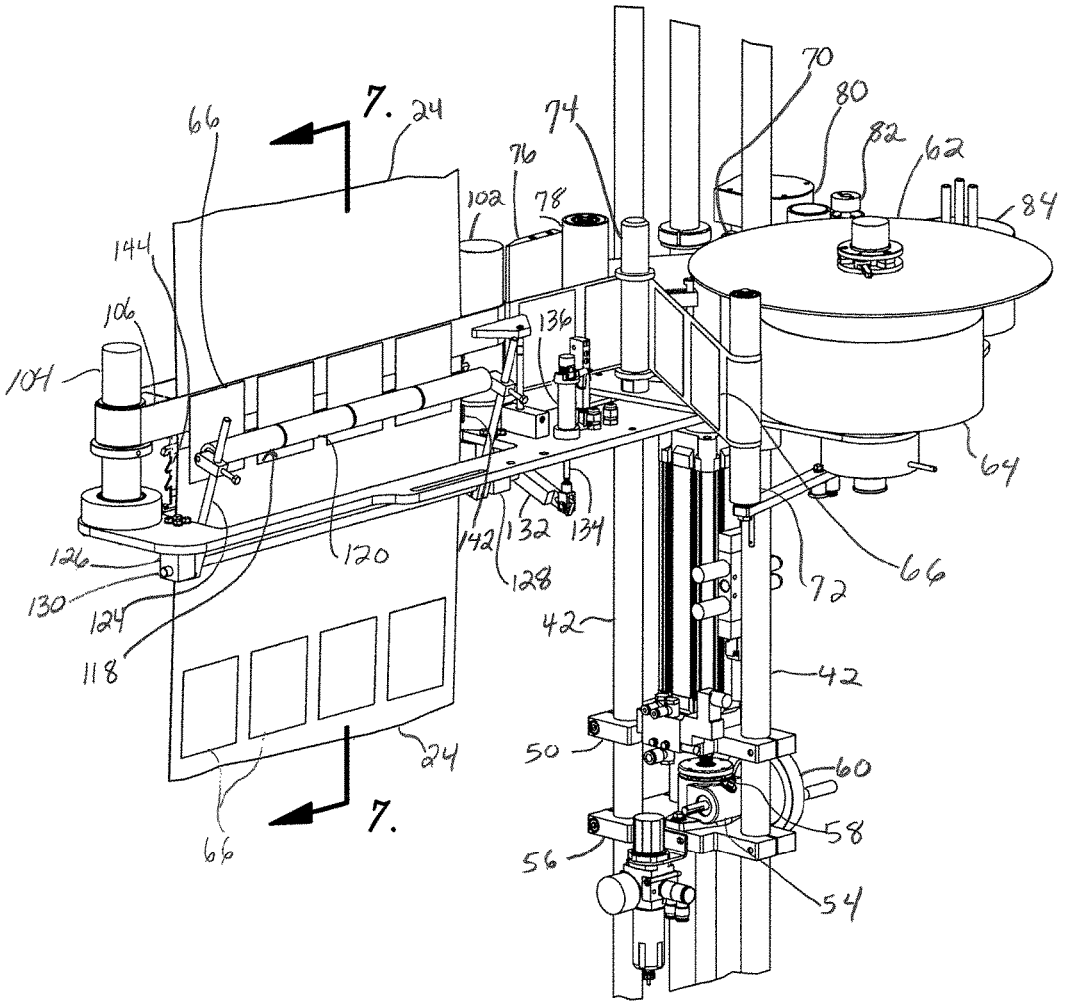
FIG. 3 is an enlarged fragmentary perspective view of the labeling device.
Figure 4:
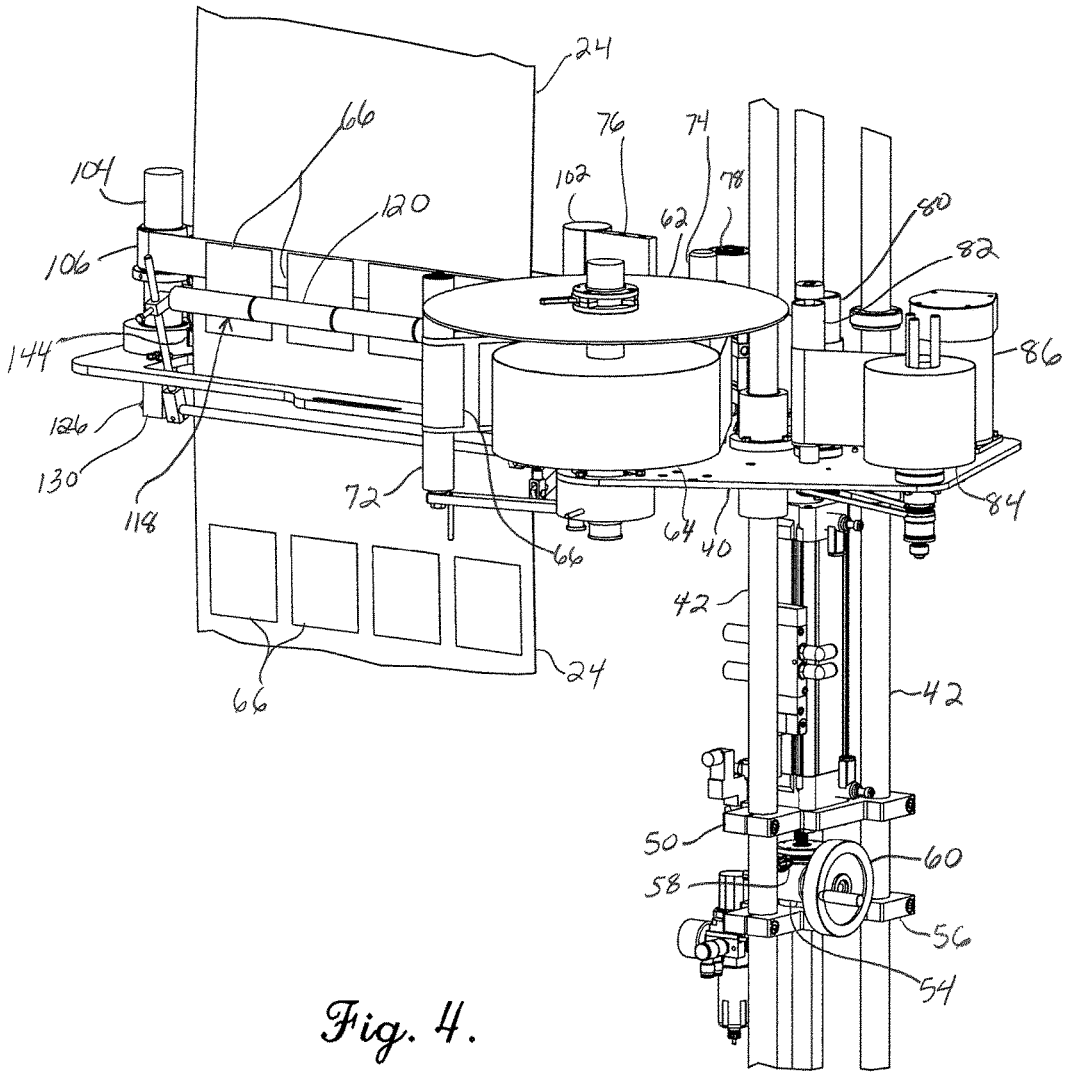
FIG. 4 is a fragmentary perspective of the labeling device shown in FIG. 3, but taken from a different perspective.
Figure 5:
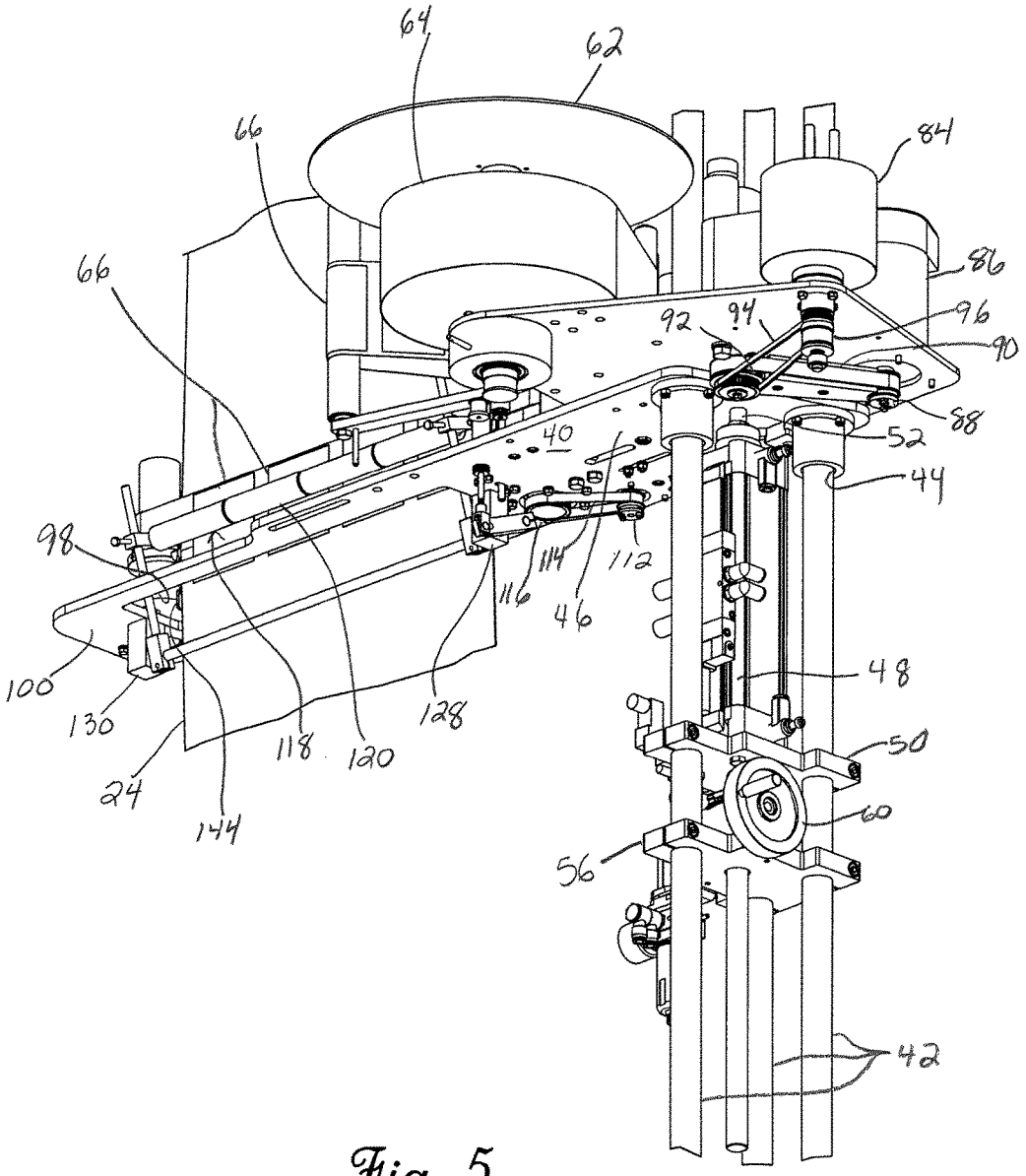
FIG. 5 is a fragmentary bottom perspective view of the labeling device shown in FIG. 3.
Figure 6:
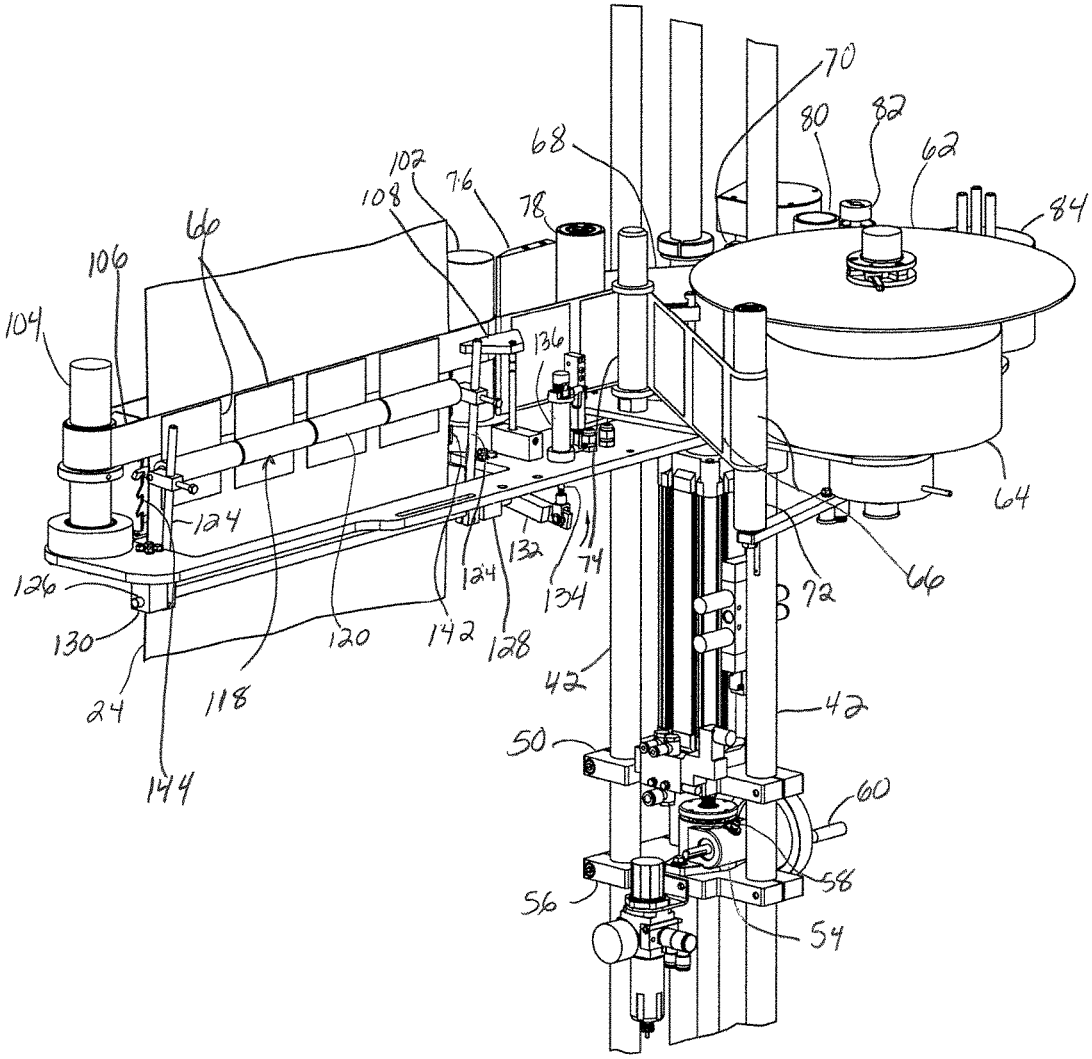
FIG. 6 is a fragmentary perspective view of the labeling device shown in FIG. 3 and taken from the same perspective as shown in FIG. 3, but showing the labeling device in a different operational sequence from that shown in FIG. 3.

Turning now to the drawings in greater detail, and initially to FIGS. 1 and 2, a conventional horizontal form-fill-seal machine is represented broadly by the numeral 10 and comprises a forming station 12 where rows of side-by-side product receptacles 14 are formed in a bottom film 16 dispensed in a step-wise indexing fashion from a roll 18. Product 20 is placed in the product receptacles 14 by hand or using a suitable dispenser (not shown).

The machine 10 includes a sealing station 22 that heat seals or otherwise secures a top film 24 to the bottom film 16 to form a number of product packages 26 following dispensing of the product 20 into the product receptacles 14. The top film 24 is dispensed from a roll 28 in the same step-wise indexing fashion as the bottom film 16. The roll 28 is positioned at an overhead portion 30 of the machine 10 and the top film 24 is routed so that it feeds vertically downward to an upstream end of the sealing station 22 prior to joinder with the horizontally-advancing bottom film 16.

The machine 10 also includes a cutting station 32 where individual or groups of the product packages 26 may be separated from other individual or groups of product packages 26. Other details of the machine 10 need not be described herein because it is of conventional construction. It is also to be understood that the machine 10 is but one embodiment of the types of form-fill-seal machines and package thermoforming devices with which a labeling device 34 of the present invention can be used.

The labeling device 34 is shown in FIGS. 1 and 2 positioned in operational relationship to the machine 10. The labeling device 34 includes a base 36 to which are mounted four lockable caster wheels 38 to allow the labeling device 34 to be readily transported. The labeling device 34 includes an upper platform 40 supported above the base 36 on risers 42. The risers 42 are positioned at one end 44 of the base 36 so that the remainder of the base 36 may be positioned under the machine 10 during use or storage of the labeling device 34. In the illustrated embodiment, three cylindrical risers 42 are provided, but it is to be understood that fewer or more risers 42 may be used.

Turning additionally to FIGS. 3-6, the risers 42 extend through openings 44 provided in one end 46 of the platform 40 that extends in a horizontal plane outwardly from the risers 42 in a cantilevered-fashion so that it may be positioned to overlie the sealing station 22 in the machine 10. The height of the platform 40 can be adjusted to bring it into the desired vertical position in relation to the sealing station 22. In one embodiment, this height adjustment is achieved by movement of the platform 40 along the risers 42 using a pneumatically-controlled, height adjustment cylinder 48 that extends upwardly from a first support 50 mounted on the risers 42. The cylinder 48 has a piston rod 52 that extends out of the top of the cylinder 48 and is fixed to the platform 40 so that extension and retraction of the piston rod 52 moves the platform 40 upwardly and downwardly, respectively.

The cylinder 48 can be used to quickly move the platform 40 into roughly the desired vertical position. More precise vertical positioning of the platform 40 can then be achieved by use of a screw jack 54 that is mounted to a second support 56 fixed to the risers 42 below the first support 50. The screw jack 54 includes a threaded rod 58 that extends upwardly to contact an undersurface of the first support 50 on which the cylinder 48 is mounted. A wheeled hand crank 60 is provided and, when turned, causes extension and retraction of the threaded rod 58 to move the first support 50 up and down on the risers 42. In another embodiment, the risers 42 may be formed as telescoping risers and the platform 40 is fixed to the risers 42 such that extension or contraction of the risers 42 using the cylinder 48 and/or the screw jack 54 causes adjustment of the height of the platform 40.

The platform 40 serves as a mounting surface for a variety of operational components of the labeling device 34, including a label dispensing unit 61. The label dispensing unit 61 includes a first spool 62 on which a label roll 64 is positioned is mounted on a top surface of the platform 40. The label roll 64 contains individual labels 66 that are removably fixed to a backing web 68. The labels 66 and backing web 68 are unwound from the label roll 64 and are routed around a series of guide rollers 70, 72 and 74 before encountering a label peeler blade 76 that serves to separate the labels 66 from the backing web 68. The backing web 68 from which the labels 66 have been separated is routed along the backside of the label peeler blade 76 and around another series of guide rollers 78, 80, and 82 before being delivered to a take-up reel 84.

The label dispensing unit 61 includes a first stepper motor 86 mounted on the top surface of the platform 40. The first stepper motor 86 drives a pulley 88 positioned underneath the platform 40, which is connected by a belt 90 to a double pulley 92 connected to the guide roller 80. Another belt 94 connects the double pulley 92 to a pulley 96 connected to the take-up reel 84 to synchronize the rotation of the guide roller 80, which serves as a drive roller for the backing web 68, with that of the take-up reel 84 for the backing web 68.

The label peeler blade 76 forms part of the label dispensing unit 61 and is positioned on the platform 40 at a location adjacent a wide slot 98 formed in the platform 40 and extends from an intermediate portion of the platform 40 to near an end 100 of the platform 40 that is opposite from the end 46 of the platform 40 through which the risers 42 extend. The slot 98 has a length sufficient to accommodate the width of the top film 24. First and second rollers 102 and 104 are positioned at opposite ends of the slot 98 and carry at least one belt 106 that is used to deliver the series of labels 66 into registry with the top film 24 that is routed generally vertically downward through the slot 98. The first and second rollers 102 and 104 are of a sufficient diameter to create a corresponding separation between the front and back lengths of the belt 106 to allow the top film 24 to be also be routed between those lengths of the belt 106. For larger-sized labels 66, a wider belt 106 may be used or a second belt (not shown) may be carried by the rollers 102 and 104 above the first belt 106. The first roller 102 is positioned close to the label peeler blade 76 so that as the labels 66 are peeled from the backing web 68 they are carried onto the belt 106. An adjustable wedge 108 is positioned in overlapping relationship to the label peeler blade 76 and the first roller 102 to force the peeled labels 66 against the belt 106 along the horizontal plane of the wedge 108.

The label dispensing unit 61 includes a second stepper motor 110 (FIG. 2) on the top surface of the platform 40 that is connected to a drive pulley 112 positioned just below the platform 40. The drive pulley 112 is connected by a belt 114 to a pulley 116 connected to the first roller 102 to cause step-wise rotation of the first roller 102.

A tamping mechanism 118 forms another part of the label dispensing unit 61 and is used for pressing the detached labels 66 onto the top film 24. The tamping mechanism 118 comprises a horizontally-extending tamp roller 120 that is positioned above the slot 98 in the platform 40 and below the belt 106 that carries the labels 66 into registry with the top film 24. The tamp roller 120 may be formed of roller segments positioned end to end and received on a rod 122 fixed at its ends to a pair of rocker arms 124. The rocker arms 124 extend downwardly through the slot 98 in the platform 40 and their lower ends are fixed to a pivot rod 126 that is mounted for rotation within a pair of bearing blocks 128 and 130 that are mounted to an undersurface of the platform 40. One end of the pivot rod 126 is secured by a link arm 132 to a piston rod 134 of a small pneumatic cylinder 136 that is positioned on top of the platform 40 and with its piston rod 134 extending downwardly through the platform 40. As the piston rod 134 extends and retracts, it causes the rocker arms 124 and the tamp roller 120 to rock toward and away from the top film 24. A backer rod 138 positioned in any of various slots 140 formed at different heights in two upright brackets 142 and 144 positioned on the top surface of the platform 40 adjacent the slot 98. The backer rod 138 is set to the same elevation as the tamp roller 120 so that the labels 66 and top film 24 are sandwiched between the backer rod 138 and tamp roller 120 when the tamp roller 120 rocks against the labels 66. A programmable logic controller or other suitable programmable controls for operating the various components of the labeling device 34 may be located within a control box 146 positioned at the top of the risers 42.

Figure 7:
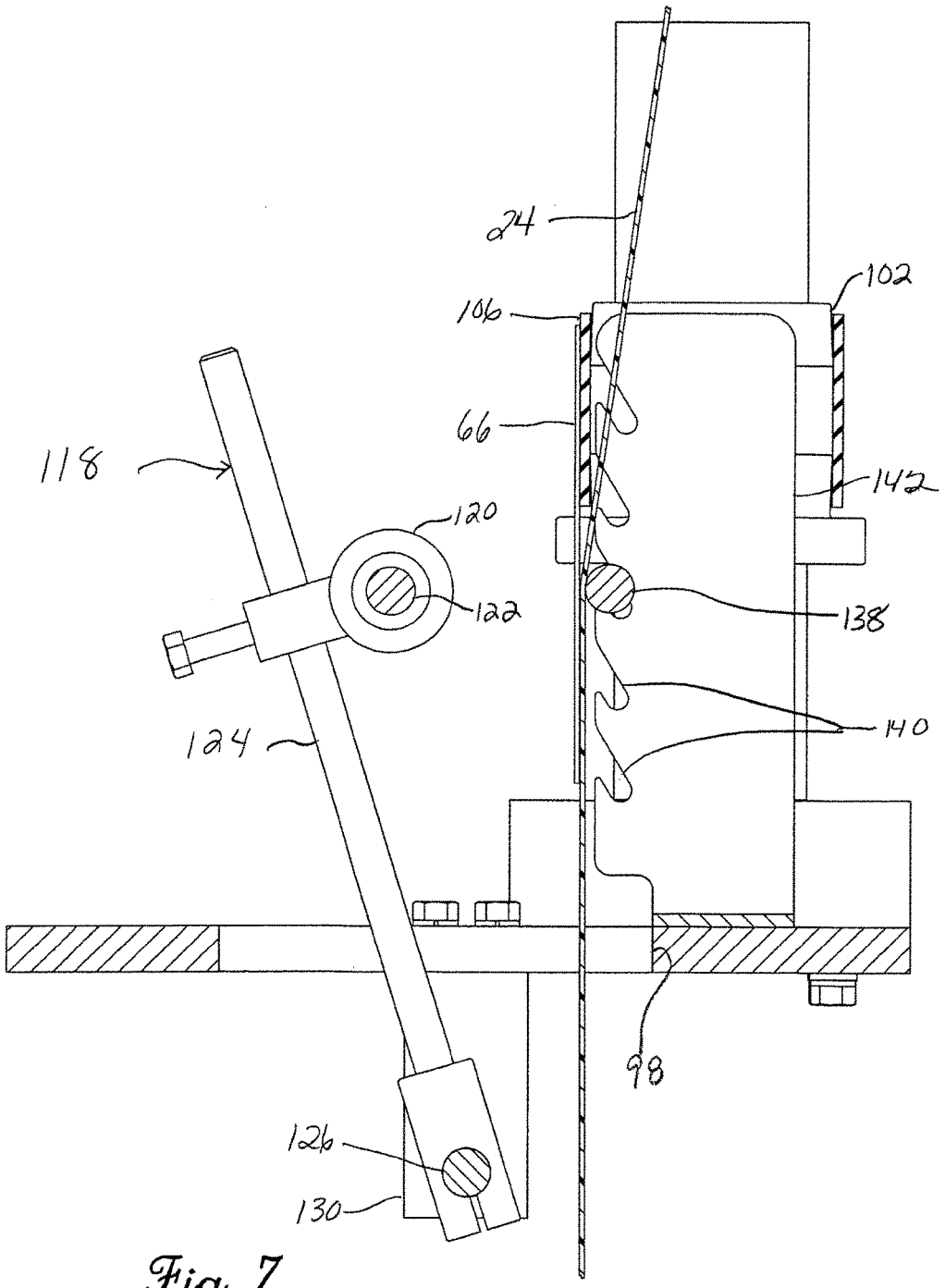
FIG. 7 is a fragmentary side elevation view of the labeling device taken in vertical section along line 7-7 of FIG. 3 in the direction of the arrows and showing a series of labels slightly spaced from and positioned for application to a top film that is subsequently used to create a portion of a product package.
Figure 8:
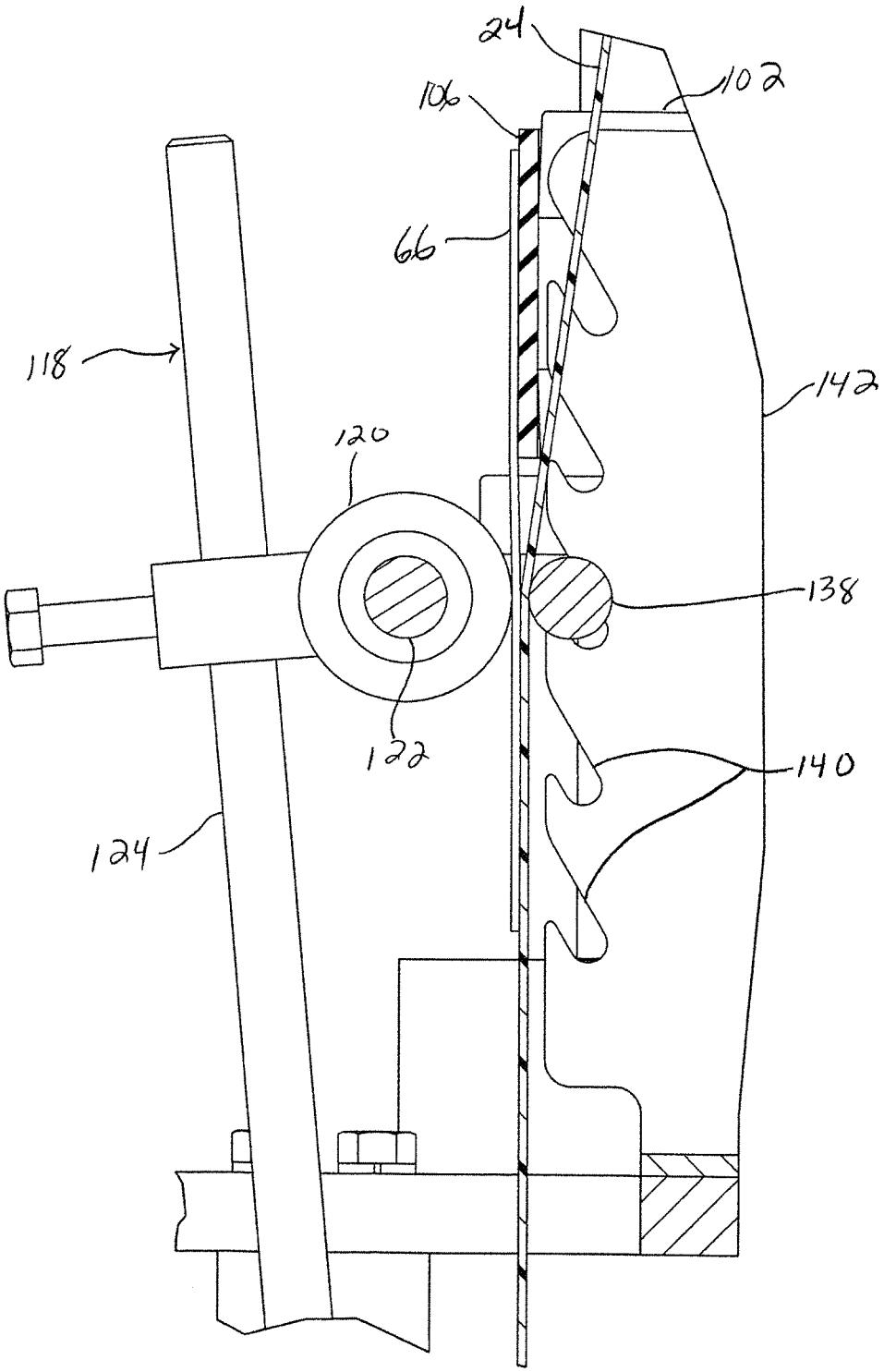
FIG. 8 is a fragmentary side elevation view of the labeling device showing the same vie seen in FIG. 7, but illustrating the operational sequence in which the series of labels is brought into contact with the top film.
Figure 9:
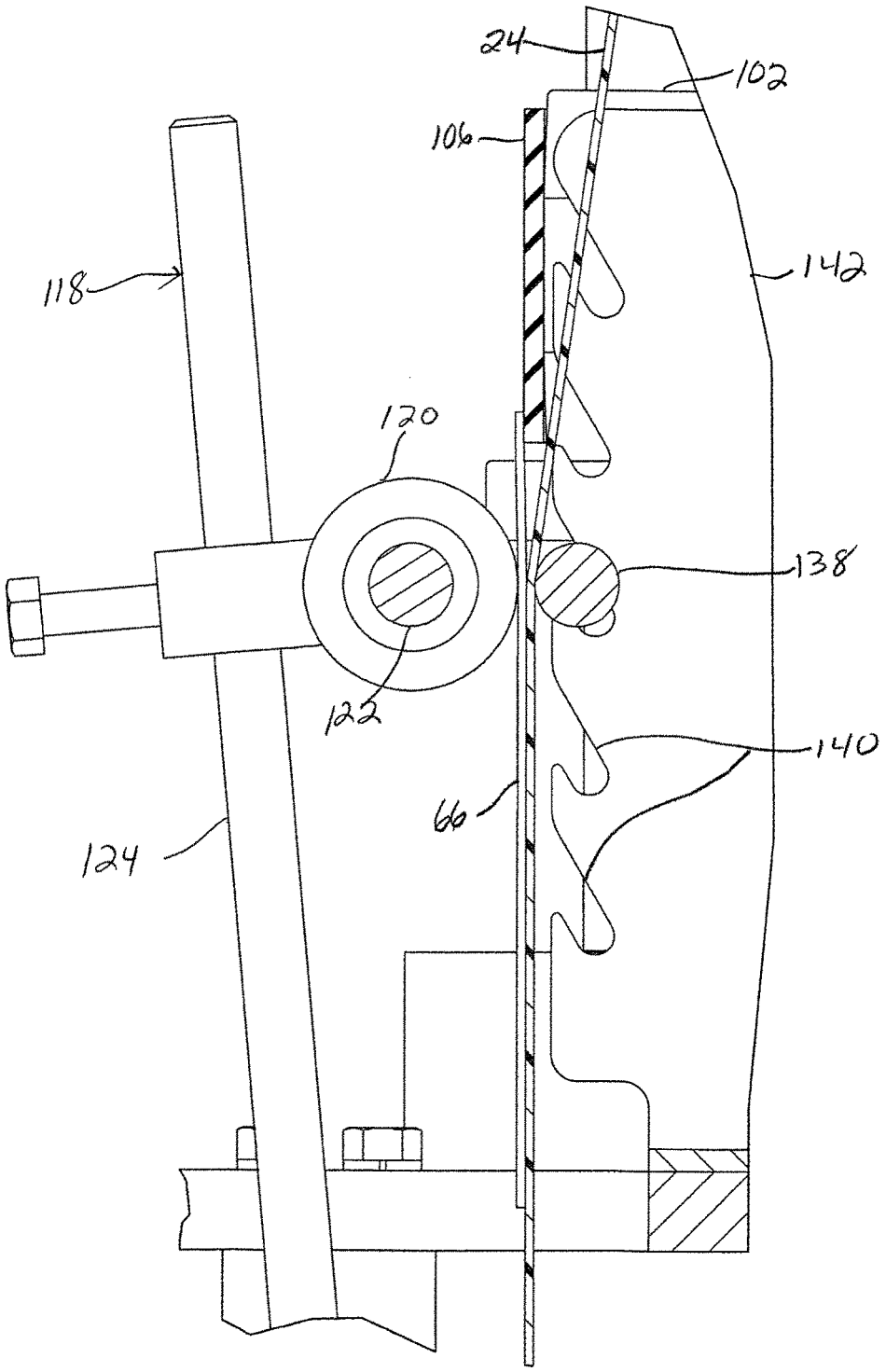
FIG. 9 is a fragmentary side elevation view of the labeling device showing the same view seen in FIGS. 7 and 8, but illustrating the operational sequence in which the top film on which the labels have been applied is advancing toward a station at which the product package is sealed by the top film.
Figure 10:
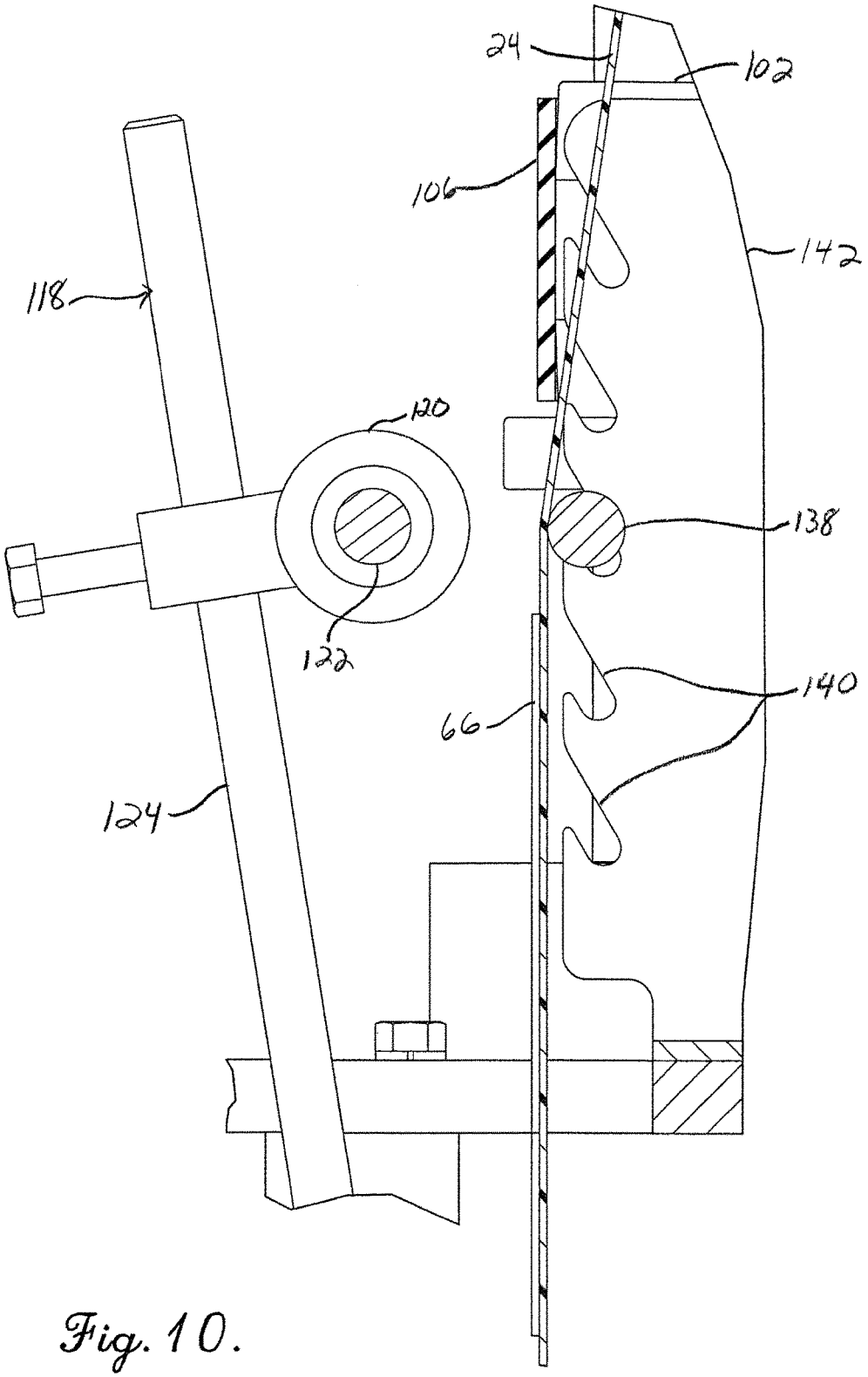
FIG. 10 is a fragmentary side elevation view of the labeling device showing the same view seen in FIGS. 7-9, but illustrating continued advancement of the top film toward the sealing station.

Turning now to FIGS. 7-9, it can be seen that during operation of the labeling device 34, the top film 24 extends downwardly and is routed between the front and back lengths of the belt 106, against the side of the backer rod 138 closest to the labels 66, and then extends through the slot 98 in the platform 40. The labels 66 are positioned such that an upper portion of the labels is carried on the belt 106 and a lower portion of the labels 66 extends below the belt 94. When the rocker arms 124 rocks toward the labels 66, the tamp roller 120 bears against and moves a lower portion of the labels 66 into contact with the top film 24. The backer rod 138 facilitates the application of pressure by the tamp roller 120 to the sandwiched lower portion of the labels 66 and the top film 24. The back side of the labels 66 are coated with a suitable adhesive that has sufficient tack to cause them to stick to the top film 24 with the application of pressure by the tamp roller 120 and backer rod 138 and then achieve a more permanent bond in the sealing station 22 (FIG. 2). The belt 106 is formed of or is coated with a suitable material that allows the top portion of the labels 66 to adhere to the belt 106 and be carried by the belt 106 into registry with the top film 24. The material must then allow the labels 66 to be pulled off of the belt 106 after the lower portions of the labels 66 are adhered to the top film 24 and the top film 24 is advanced downwardly.

During setup, the labeling device 34 is moved on wheels 38 into operational position in relation to the horizontal form-fill-seal machine and the wheels 38 are then locked to hold the labeling device 34 in the operational position. The vertical positioning of the platform 40 in relation to the sealing station 22 on the machine 10 is then adjusted as needed using the cylinder 48 to adjust the rough vertical position and the jack screw 54 to obtain more precise vertical positioning. The top film 24 is then threaded between the front and back lengths of the belt 106, along the face of the backer rod 138, and downwardly through the slot 98 in the platform 40. The top film 24 is then delivered to the sealing station 22 of the machine 10 for joinder to the bottom film 16 to form the individual product packages 26.

The label roll 64 is then loaded on the spool 62 on the platform 40 and the backing web 68 is wound around the guide rollers 70, 72, and 74, around the label peeler blade 76, around the guide rollers 78, 80, and 82, and is fixed to the take-up reel 84. The tamper mechanism 118 is then adjusted so that the tamp roller 120 and the backer rod 138 are aligned and are spaced below the belt 114 the desired distance for the specific labels 66 that are being applied by the labeling device 34 to the top film 24.

During operation of the labeling device 34, the first stepper motor 86 is sequentially activated for preset periods of time to cause the labels 66 and backing web 68 to unwind from the label roll 64. The indexing or activation period is sufficient to cause the desired number of labels 66 to be separated from the backing web 68 at the label peeler blade 76 and carried onto the moving belt 106.

The second stepper motor 110 is activated in timed-sequence with the first stepper motor 86 to cause rotation of the belt 106 to bring the separated labels 66 into registry with the top film 24. Only the top portions of the labels 66 are applied to the belt 106 and the bottom portions of the labels 66 hang downwardly below the belt 106 and are spaced slightly from the downwardly extending top film 24.

The tamper mechanism 118 is then activated by retraction of the piston rod 134 of the small cylinder 136 to cause the tamp roller 120 to rock toward and press the bottom portions of the labels 66 onto the top film 24 and against the stationary backer rod 138. The tamp roller 120 remains engaged in this position as the machine 10 indexes to cause the top film 24 to advance toward or to the sealing station 22 where the top film 24 carrying the labels 66 is heat-sealed or otherwise joined to the bottom film 16 to create the product packages 26. As the top film 24 is advanced in this manner, the compression force exerted on the bottom portions of the labels 66 and the top film 24 by the tamp roller 120 and the backer rod 138, together with the slight adhesive force of the labels 66 themselves, causes the upper portions of the labels 66 to pull free from the belt 106 and adhere to the advance top film 24. The compression force exerted by the tamp roller 120 and the backer rod 138 firmly press all portions of the labels 66 onto the top film 24 as it advances between the tamp roller 120 and the backer rod 138. Once advancement of the top film 24 is stopped, the piston rod 134 of the small cylinder 136 is extended to cause the tamp roller 120 to rock in the direction away from the belt 106 and top film 24. The first and second stepper motors 86 and 110 are then reactivated to cause another series of labels 66 to be delivered onto the belt 106 and into registration with the top film 24. This sequence of steps is repeated performed to cause the step-wise, indexing application of the labels 66 to the top film 24, followed by delivery of the top film to the sealing station 22 for formation of the product packages 26.

It can thus be seen that the mobility of the labeling device 34 allows it to be readily moved between multiple ones of the machines 10 to reduce the need for each machine 10 to have its own dedicated labeler. The ability to position the labeling device 34 only a slight distance above the sealing station 22 of the machine 10 means that the top film 24 is indexed a fewer number of times to advance the top film 24 and labels 66 to the sealing station 22 than is required for conventional labeling devices mounted at the top of the machine 10. This reduces wasting of the labels 66 and product packages 26 during initial startup and restarting of the machine 10. The ability to apply the labels 66 to the top film 24 along the pre-existing, vertically downward path of travel of the top film 24 just prior to delivery of the top film 24 to the sealing station 22 is advantageous because it does not require rerouting of the top film 24, which can increase the opportunity for tracking problems with the top film 24. Reducing such tracking problems reduces the operational downtime for the machine 10 and reduces the number of labels 66 and unlabeled product packages 26 that would need to be discarded. The ability to quickly and easily adjust the height of the platform 40 is also advantageous during initial setup because it allows flexibility in the location where the labels 66 are applied to the top film 24 to accommodate the specific indexing cycle used with the machine 10. The operational components of the labeling device 34 are also within easy reach of a person standing on the floor, thereby facilitating setup of the labeling device 34 and replacement of the label roll 64 and take-up reel 84.

It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A method of sequentially applying labels to a top film in a form-fill-seal machine that operates to join the top film to a bottom film in a sealing station to form product packages, said method comprising the steps of:

moving a portable labeling device comprising a platform carrying a plurality of labels on a web into an operational position in relation to the form-fill-seal machine;

adjusting a vertical position of the platform in relation to the sealing station of the form-fill-seal machine;

routing the top film from an overhead portion of the form-fill-seal machine in a downwardly extending direction to the sealing station;

separating a plurality of the labels from the web carrying the labels;

advancing the separated labels onto a belt moving in a horizontal direction across one face of the downwardly extending top film before it enters the sealing station and causing one portion of a back side of each of the labels to releaseably adhere to the moving belt;

stopping movement of the belt after the labels that are releaseably adhered to the belt are in a preselected registration in relation to the downwardly extending top film;

pressing another portion of the back side of each of the labels that are releaseably adhered to the belt into contact with the top film and causing said another portion of the back side of each of the labels to stick to the downwardly extending portion of the top film; and advancing the top film in said downwardly extending direction and causing said one portion of the back side of each of the labels to release from the belt and contact and then stick to the downwardly extending portion of the top film.

2. The method of claim 1, wherein said step of causing one portion of the back side each of the labels to releaseably adhere to the moving belt comprises the step of causing a top portion of the back side of each of the labels to releaseably adhere to the moving belt.

3. The method of claim 2, wherein said step of pressing another portion of the back side of each of the labels comprises the step of pressing a bottom portion of the back side of each of the labels.

4. The method of claim 3, including using an adjustable wedge to force each of the labels against the moving belt to cause said one portion of the back face of each of the labels to releaseably adhere to the moving belt.

5. The method of claim 1, including compressing said bottom portion of each of the labels and the top film between a tamp roller and a backer rod to cause said step of pressing another portion of the back side of each of the labels and to cause said release of the one portion of the back side of each of the labels during said advancing of the top film.

6. The method of claim 5, including compressing the remaining portions of each of the labels between the tamp roller and the backer rod during said step of advancing the top film to press the remaining portions of the back side of said labels into contact with the top film and cause the remaining portions of the back side of the labels to stick to the top film.

7. A method of sequentially applying labels to a top film in a form-fill-seal machine that operates to join the top film to a bottom film in a sealing station to form product packages, said method comprising the steps of:

separating a plurality of the labels from a web carrying the labels;

advancing the separated labels onto a belt moving in a horizontal direction across one face of a portion of the top film that is extending in a downward direction from an overhead portion of the form-fill-seal machine to the sealing station and using an adjustable wedge to force each of the labels against the moving belt to cause one portion of a back face of each of the labels to releaseably adhere to the moving belt;

stopping movement of the belt after the labels that are releaseably adhered to the belt are in a preselected registration in relation to the portion of the top film that is extending in the downward direction;

pressing another portion of the back face of each of the labels that are releaseably adhered to the belt into contact with the portion of the top film that is extending in the downward direction and causing said another portion of the back face of each of the labels to stick to the portion of the top film that is extending in the downward direction; and advancing the top film in said downward direction and causing sad one portion of the back face of each of the labels to release from the belt and then contact and stick to the top film before it enters the sealing station;

wherein said step of causing one portion of the back side of each of the labels to releasably adhere to the moving belt comprises the step of causing a top portion of the back side of each of the labels to releaseably adhere to the moving belt;

wherein said step of pressing another portion of the back side of each of the labels comprises compressing a bottom portion of the back side of each of the labels and the top film between a tamp roller and a backer rod to cause said release of the one portion of the back side of each of the labels during said advancing of the top film;

compressing the remaining portions of each of the labels between the tamp roller and the backer rod during said step of advancing the top film to press the remaining portions of the back side of said labels into contact with the top film and cause the remaining portions of the back side of the labels to stick to the top film, and placing the web carrying the labels on an adjustable platform and adjusting a vertical position of the platform in relation to the sealing station of the form-fill-seal machine.

8. The method of claim 7, including dispensing said top film from a roll positioned at said overhead portion of the form-fill-seal machine.

* * * * *